US007543726B2

(12) United States Patent
MacNaughton

(10) Patent No.: US 7,543,726 B2
(45) Date of Patent: Jun. 9, 2009

(54) MANUAL LOAD CARRYING SYSTEM/APPARATUS

(76) Inventor: Alastair G. MacNaughton, 2 Kenwood Ave., Toronto, Ontario (CA) M6C 2R7

( * ) Notice: Subject to any disclaimer, the term of this patent is extended or adjusted under 35 U.S.C. 154(b) by 604 days.

(21) Appl. No.: 11/059,241

(22) Filed: Feb. 16, 2005

(65) Prior Publication Data

US 2006/0180618 A1 Aug. 17, 2006

(51) Int. Cl.
*A45F 5/00* (2006.01)
*A45F 3/00* (2006.01)

(52) U.S. Cl. ..... 224/679; 224/268; 224/269; 224/668

(58) Field of Classification Search ..... 224/679, 224/668, 268, 269, 669
See application file for complete search history.

(56) References Cited

U.S. PATENT DOCUMENTS

| | | | | | |
|---|---|---|---|---|---|
| 1,015,176 | A | * | 1/1912 | Hall | 220/759 |
| 1,540,358 | A | * | 6/1925 | Maurer | 220/759 |
| 2,613,860 | A | * | 10/1952 | Hoffman | 294/162 |
| 2,651,441 | A | | 9/1953 | Rau et al. | |
| 3,107,028 | A | | 10/1963 | De Robertis | |
| 3,285,482 | A | | 11/1966 | Bedsaul, Sr. | |
| 3,493,152 | A | | 2/1970 | Ort | |
| 4,172,542 | A | | 10/1979 | Lankford | |
| 4,215,789 | A | * | 8/1980 | Pfeifer | 220/762 |
| 4,325,503 | A | | 4/1982 | Swinney | |
| 4,834,438 | A | | 5/1989 | Haidet | |
| 4,940,255 | A | | 7/1990 | Donine | |
| 5,158,510 | A | | 10/1992 | Lemire | |
| 5,325,990 | A | * | 7/1994 | Temple | 220/628 |
| 5,490,618 | A | | 2/1996 | Davidson | |
| 5,505,331 | A | * | 4/1996 | Rathbun | 220/764 |
| 5,511,707 | A | | 4/1996 | Reichert | |
| 5,730,339 | A | | 3/1998 | Stolfo | |
| 5,761,987 | A | * | 6/1998 | Leon et al. | 99/297 |
| 5,799,997 | A | | 9/1998 | Lehn et al. | |
| 5,943,696 | A | | 8/1999 | Walker | |
| 6,006,966 | A | | 12/1999 | Voisin, Jr. | |
| 6,843,205 | B1 | * | 1/2005 | Segreto | 119/74 |
| 2003/0052144 | A1 | | 3/2003 | Vardi | |

* cited by examiner

*Primary Examiner*—Nathan J Newhouse
*Assistant Examiner*—Lester L Vanterpool
(74) *Attorney, Agent, or Firm*—Shook, Hardy & Bacon, LLP

(57) ABSTRACT

A load receiver (such as a bucket) has a hook receptor and a handle receptor or handle. The handle or handle receptor is positioned perimetrically opposite the hook receptor. This load receptor may be used with a hip worn belt having a depending hook that is received by the hook receptor and, where there is a handle receptor, with a rod-like handle that is inserted in the handle receptor.

9 Claims, 4 Drawing Sheets

MANUAL LOAD CARRYING SYSTEM/APPARATUS

BACKGROUND

This invention relates to a load receiver, a carrying system using the load receiver, and a method of carrying a load.

Many loads are manually carried at a construction site. For example, five gallon (18.9 litre) buckets are common at a construction site for bringing in construction materials (e.g., paint) and for use in disposing of waste materials. These buckets typically have a wire handle pivotably attached at either end proximate the top of the bucket, with a medially grip on the wire. A filled bucket can weigh on the order of twenty-five kilograms. Repeated carrying of these heavy loads is very tiring for the construction workers. Further, due to their unwieldy nature, carrying of these loads also risks worker injury, especially when the worker has tired.

US 2003/0052144 to Vardi published Mar. 20, 2003 discloses a waist worn belt with a loop for assisting in the moving of large objects, such as sheet material. While this apparatus may assist a worker in certain instances, in other circumstances, the apparatus would not be of assistance.

SUMMARY OF INVENTION

The present invention provides a load receiver (such as a bucket) with a hook receptor and a handle or a handle receptor. The handle or handle receptor is positioned perimetrically opposite the hook receptor.

This load receptor may be used with a hip worn belt having a depending hook that is received by the hook receptor and, where there is a handle receptor, with a rod-like handle inserted in the handle receptor.

Accordingly, the present invention provides a load receiver for use in a carrying system, comprising: a bottom wall for receiving a load; a hook receptor; a handle or a handle receptor, the handle or handle receptor being perimetrically opposite the hook receptor.

According to another aspect of the present invention, there is provided a carrying system, comprising: a load receiver having a bottom wall for receiving a load; a hook receptor; and a handle receptor, said handle receptor perimetrically opposite said hook receptor; a belt having a depending hook for hooking to said hook receptor.

Other features and advantages of the present invention will be apparent from the following description in conjunction with the drawings.

BRIEF DESCRIPTION OF THE DRAWINGS

In the figures which illustrate example embodiments of the invention.

DETAILED DESCRIPTION

Figure 2:
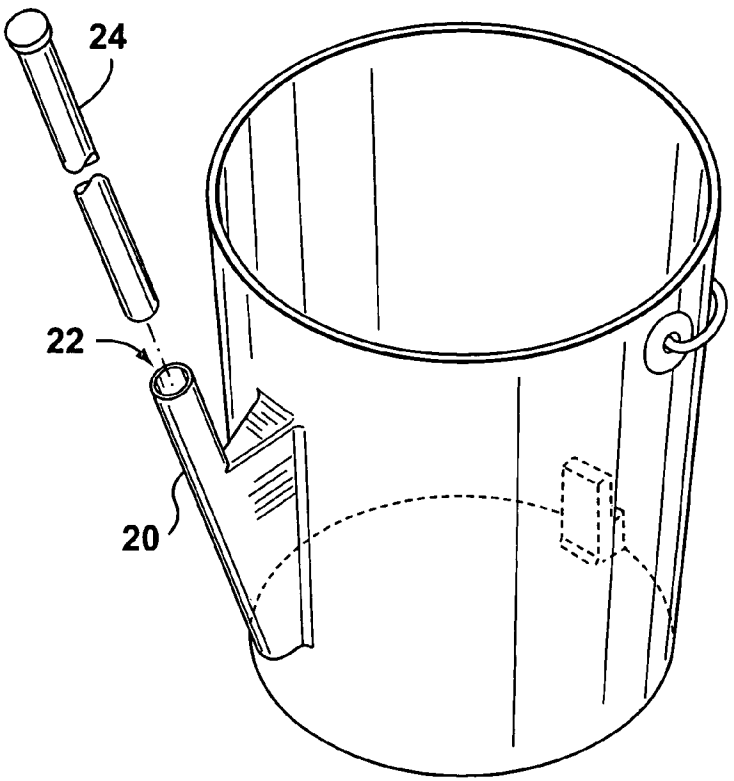
FIG. 2 is a perspective rear view of the bucket of FIG. 1.
Figure 1:
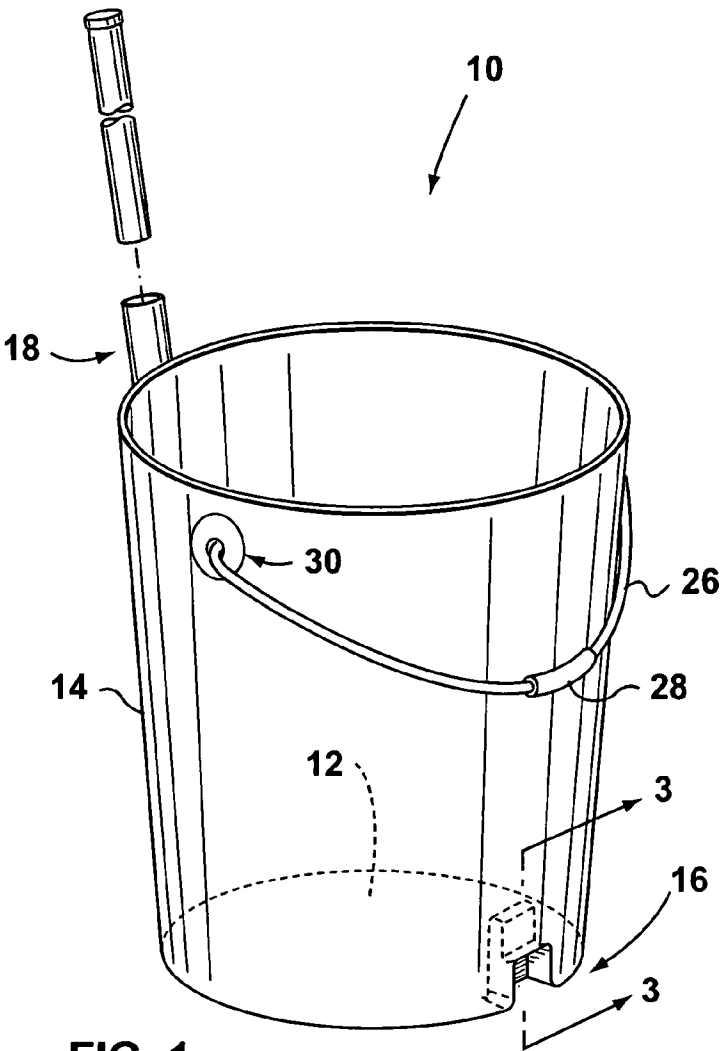
FIG. 1 is a perspective front view of a load receiving bucket made in accordance with this invention.

Turning to FIGS. 1 and 2, a load receiver in the nature of a bucket 10 has a bottom wall 12 for receiving a load and an upstanding side wall 14. A hook receptor 16 and a handle receptor 18 are integrally formed with the side wall 14. As will be apparent from the figures, the handle receptor is perimetrically opposite the hook receptor (i.e., it is circumferentially opposite the hook receptor). As shown, the handle receptor is a housing 20 defining a tubular opening 22 for receiving a rod-like handle 24. The tubular opening is oriented such that with the bottom of the bucket resting on a horizontal floor, the tubular opening projects upwardly and outwardly. The tubular opening 22 may be cylindrical and defined by a featureless wall.

Figure 3:
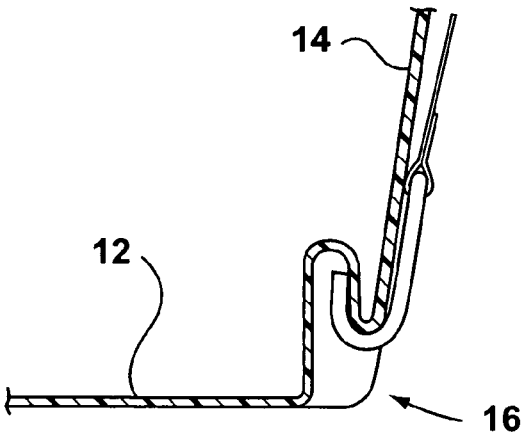
FIG. 3 is a cross-sectional view along the lines 3-3 of FIG. 1.

With reference to FIG. 3 along with FIG. 1, the hook receptor 16 may be an inwardly directed notch molded into the upstanding side wall 14, which notch extends from the bottom of this wall. As seen in FIG. 3, this notch may have, in cross-section, an inverted J-shape.

The bucket may also have a wire handle 26 with a medial grip 28 pivoted to the bucket at pivots 30. As shown, pivots 30 are spaced from handle receptor 18 and hook receptor 16 along the perimeter of the bucket by 90°. However, equally, pivots 30 could be angularly aligned with respective ones of handle receptor 18 and hook receptor 16 along the perimeter of the bucket as this may facilitate hand-off of the bucket from a person carrying it with the subject carrying system to a person carrying it by its wire handle 26.

Figures 4, 4A:
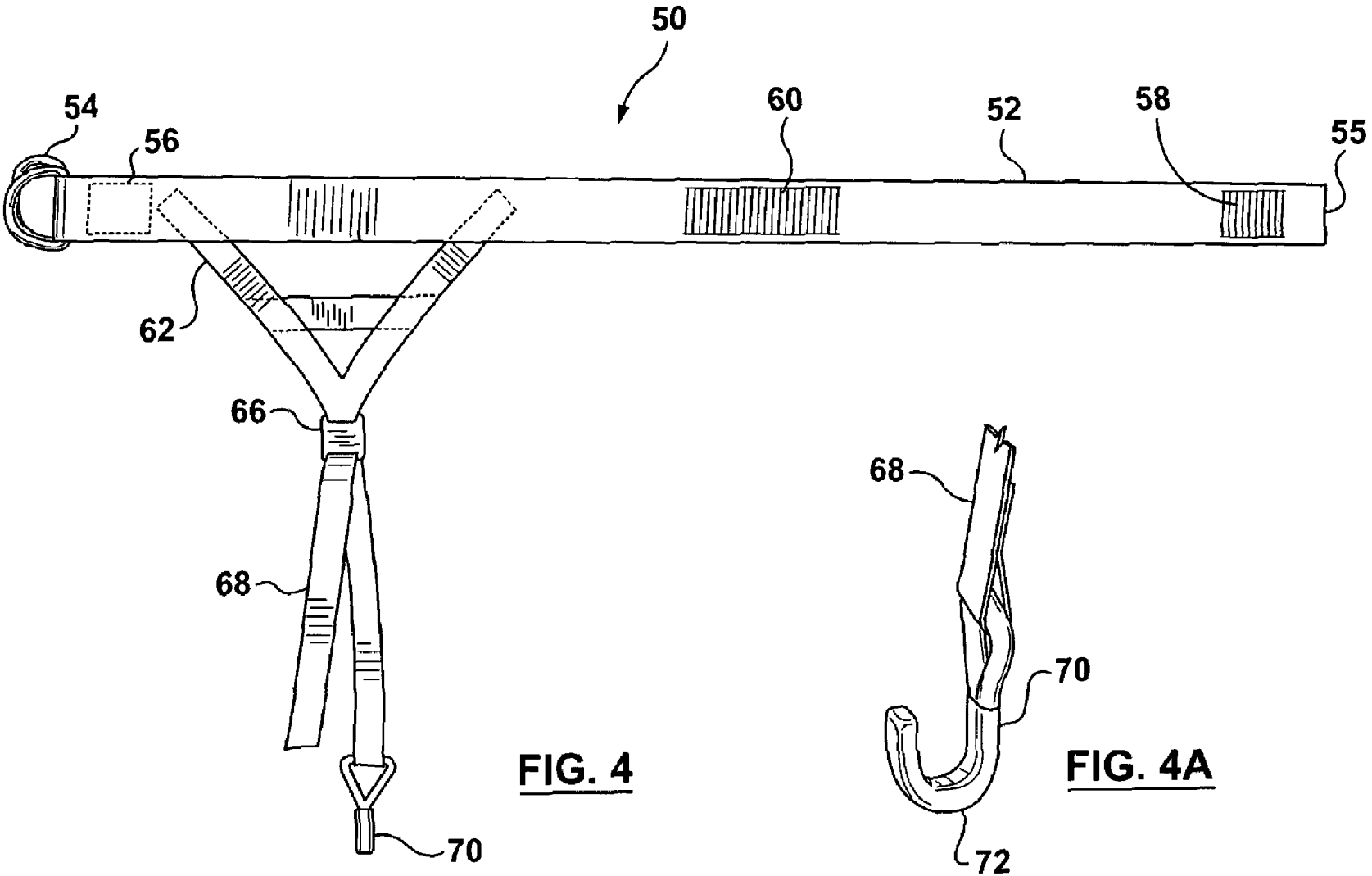
FIG. 4 is a front view of a belt for use in a load carrying system made in accordance with this invention.
FIG. 4A is a fragmentary perspective view of a portion of the belt of FIG. 4.

The bucket 10 may be carried using the carrying belt of FIG. 4. Turning to FIG. 4, carrying belt 50 has a belt portion 52 with a pair of rings 54 at one end. Each of the rings may be held at the end of the belt by folding one end of the belt over through the rings and sewing the folded over end of the belt to the remainder of the belt as indicated at 56. A patch 58 of loops may be sewn to end 55 of the belt portion 52 remote from rings 54. A patch 60 of hooks may be sewn to belt 50 about mid-way along the belt. Belt portion 52 has a depending hook. More specifically, a support strap 62 loops through a cam lock 66 and is attached at its two ends to belt 52. A further piece of material (not shown) may be sewn to the support strap 62 to prevent the cam lock 66 from sliding on the support strap. The cam lock 66 clamps a strap 68 which terminates at one end in a hook 70, which hook is best seen in FIG. 4A.

Figure 5:
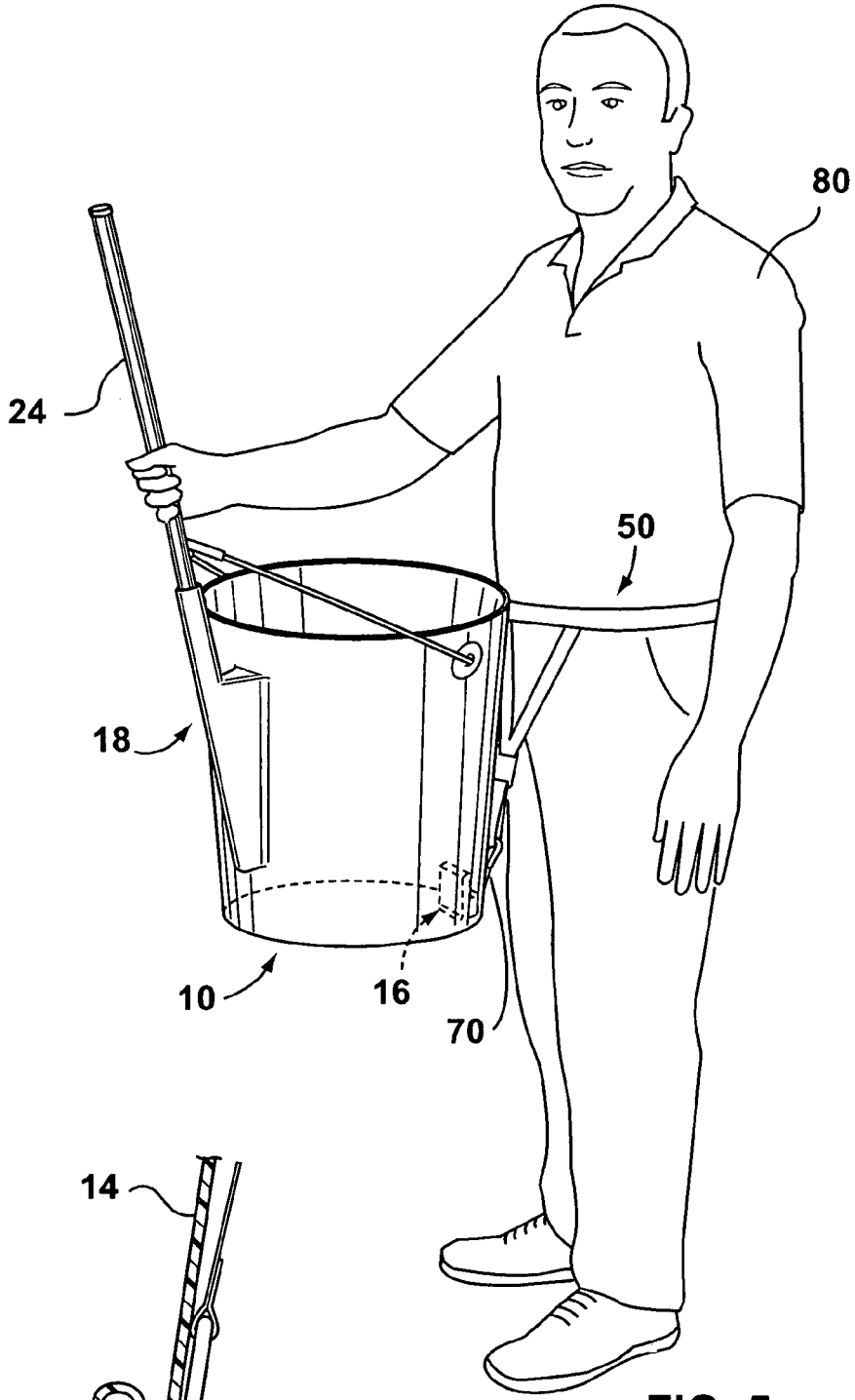
FIG. 5 is a perspective view of a load carrying system including the bucket of FIG. 1 and belt of FIGS. 4 and 4A.

With reference to FIG. 5 along with FIG. 4, in use, a user 80 may mount carrying belt 50 at his hips by inserting the free end 55 of the belt portion 52 through both rings 54 and then drawing the end 55 back through one of the rings, securing the free end 55 by marrying the loop patch 58 with hook patch 60. The user may then slide the belt portion 52 around his waist until the hook 70 dangles between his legs. Next the user may adjust the height of the hook 70 by manipulating cam lock 66 and sliding strap 68 within cam lock 66. At any time thereafter, such as when a bucket 10 has been filled with waste, the user may insert a rod-like handle 24 into handle receptor 18 of the bucket 10. Then the user may squat, hook the hook 70 into hook receptor 16, grasp the handle 24 and stand. The weight of the bucket will then be borne at the hips of the user. Further, the user may stabilise the bucket using rod 24 as the user walks while carrying the bucket. In this regard, having the rod receptor 18 perimetrically opposite the hook receptor 16 gives the user firm control of the bucket using only one hand. When reaching a destination for the contents of the bucket, the user may again squat to place the bucket on a support surface and unhook the hook. The rod 24 may then be removed from the bucket.

Although the wall of the tubular opening 22 is unthreaded, after insertion of a rod, due to the orientation of the tubular opening (projecting upwardly and outwardly), the rod will be torqued within the opening by a user carrying a load in the bucket. This will cause the rod to bind in the tubular opening (so long as the opening is sufficiently long), thereby frictionally holding the rod in place.

Optionally, the wall of the tubular opening 22 may be threaded rather than featureless. In such instance rod 24 would also be threaded. Threading the rod into opening 24 would slow the speed with which the rod may be inserted into the opening, however, it would provide a more secure connection between the rod and the housing 20, which may be desirable in some instances. As a further option, both rod 24 and the walls of the tubular opening 22 may be ribbed so as to enhance the connection between the rod and the housing 20. The tubular opening may be a blind opening, or it may extend all the way through housing 20. In the latter instance, rod 24 may be inserted so that it protrudes below the base of housing 20. With this option, the rod may have a bulge at its bottom end (which bulge may be sized to be able to pass through the tubular opening). With the bulged end of the rod extending below the housing 20, the rod is more securely held within the housing 20. As another option, the rod may be permanently attached to the bucket. In such instance, the handle receptor 18 and rod-like handle 24 may be one integral part that is integrally formed with the bucket.

The hook receptor 16 has been shown extending from the bottom of the bucket 10 since the side wall will have more rigidity at its base due to its connection with the bottom wall 12. Optionally, and at least where the side wall has sufficient strength, the hook receptor 16 may be positioned higher up on the side wall 14. However, the hook receptor is desirably not positioned so high on the bucket that the bucket will bang in to the knees of a user. Also, while the hook receptor has been shown as an inverted J-shaped notch molded into the side wall of the bucket, the hook receptor may have other configurations. For example, the hook receptor could simply be a lip at the bottom of the bucket, or a catch, such as a staple, projecting outwardly from the bucket. Alternatively, the hook receptor could extend in, or from, the bottom wall of the bucket rather than the side wall.

While the bucket 10 has been shown as generally frustoconical in shape, equally it may have any other shape, such as a box-like shape. Further, rather than being used for disposal of waste, the bucket may contain paint or some other material that is needed at a construction site.

Figure 6:
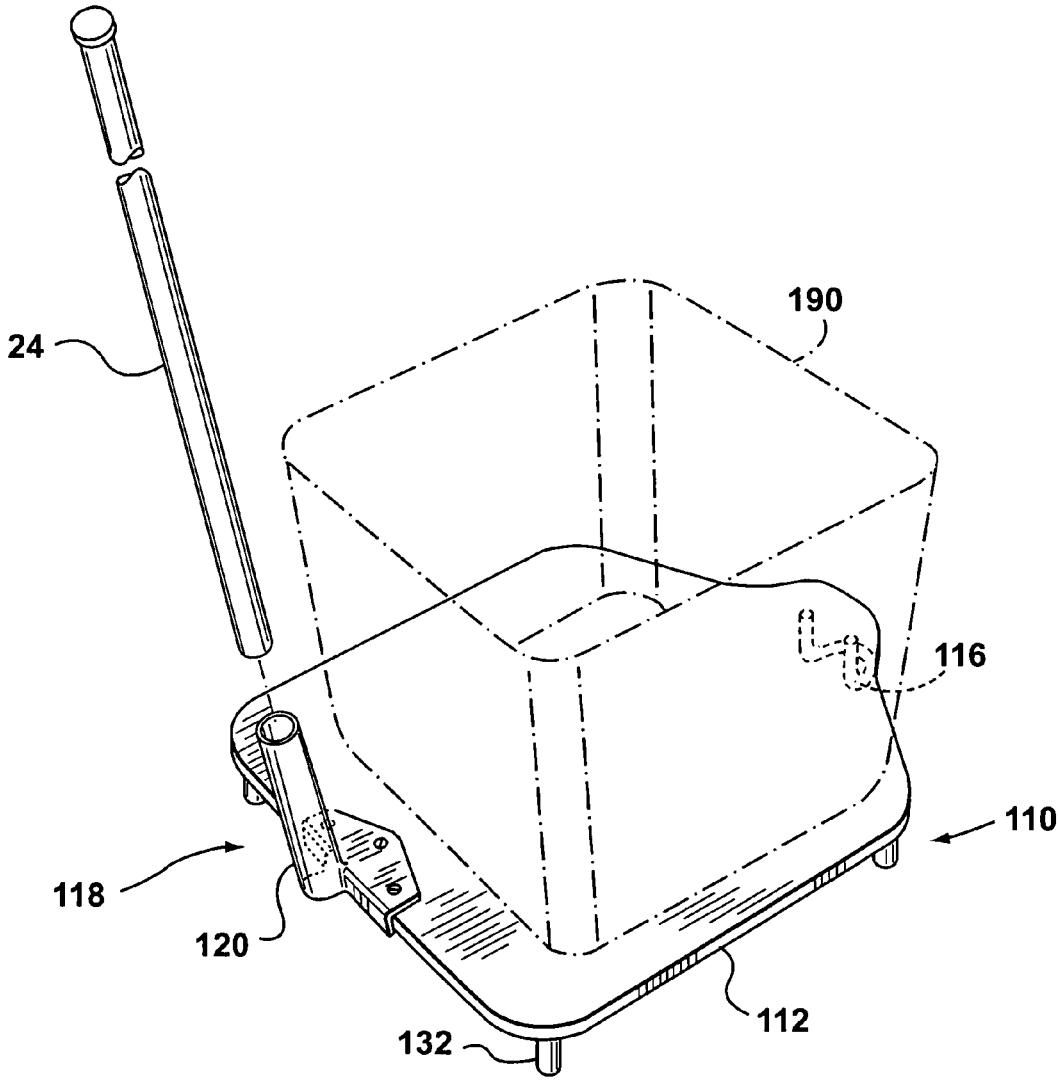
FIG. 6 is a perspective view of a load receiving platform made in accordance with another embodiment of this invention.

Turning to FIG. 6, in another embodiment, a load receiver 110 has a bottom wall in the nature of a platform 112. The platform 112 is supported on legs 132. The housing 120 of the handle receptor 118 is affixed to one side of the platform 112 and the hook receptor 116 is attached to a perimetrically opposite side of the platform. As shown, the hook receptor may be a catch which projects downwardly and outwardly from the platform.

A load, such as a filled box 190, may be placed on the platform. A user, wearing carrying belt 50, may insert a rod 24 into handle receptor 118, squat, and hook hook 70 to rod receptor 116. Thereafter, the user may stand and carry the laden load receiver 110 with relative ease.

While handle receptor 18 (FIG. 1), 118 (FIG. 6) has been shown as a cylindrical opening, the tubular opening may also be non-cylindrical.

Returning to FIG. 4A, as illustrated, hook 70 may be a wide hook covered with a plastic cover 72. As such, carrying belt 50 may be used by itself to carry certain loads. For example, a user may rotate belt 50 to position the hook at one hip and then squat to hook hook 70 under a sheet of drywall. Using this one point of attachment and one or both of his two hands, the user may then carry the dry wall sheet with relative ease.

The dual rings 54 of belt 50 together with the hook and loop fastener patches 58, 60, allow the belt 50 to be quickly and securely fastened around the hips of a user. Of course, other fasteners may also be used for the belt. For example, a simple buckle mechanism at one end of the belt could be used in conjunction with a series of eyelets in the other end of the belt to put on the belt. With the support strap 62, the hook 70, when properly positioned, may be at a relatively short distance from the support strap. In consequence, the V-shape formed by the strap 62 will aid in stabilising a load receiver 10, 110 carried on the hook, reducing the tendency of the load receiver to oscillate back and forth as a user walks. Notwithstanding this, in some instances, it may be considered sufficient to have the hook bearing strap 68 mounted directly to the belt portion 52. Also, the cam lock 66 could be replaced by any other type of clamp. Indeed, in some instances, it may be possible to fix the strap 68 non-adjustably to the belt portion 52.

Other modifications beyond those described will be apparent to those skilled in the art and, therefore, the invention is defined in the claims.

What is claimed is:

1. A carrying system, comprising:

a load receiver comprising:

a bottom wall for receiving a load, said bottom wall having a perimeter;

a hook receptor with sides which limit a position along said perimeter of a hook received by said hook receptor;

a handle receptor, said handle receptor at a position along said perimeter which is opposite said hook receptor, said handle receptor comprising a housing defining a tubular opening;

said tubular opening oriented such that with said bottom wall oriented for receiving a load thereon, said tubular opening projects upwardly and outwardly;

a cylindrical rod-shaped handle received in said handle receptor; and a belt having a depending hook for hooking to said hook receptor.

2. The load receiver of claim 1 wherein said tubular opening is cylindrical and has a featureless wall.

3. The load receiver of claim 1 wherein said housing extends from said bottom wall.

4. The load receiver of claim 3 wherein said hook receptor is a U-bolt extending from said bottom wall.

5. The load receiver of claim 1 further comprising at least one upstanding side wall such that said bottom wall and said at least one upstanding side wall define a bucket shape.

6. The load receiver of claim 5 wherein said hook receptor comprises an inwardly directed notch in one of said at least one upstanding side wall.

7. The load receiver of claim 6 wherein said inwardly directed notch extends from a bottom of said one of said at least one upstanding side wall.

8. The load receiver of claim 7 wherein said inwardly directed notch has, in cross-section, an inverted J-shape.

9. The load receiver of claim 8 wherein said housing extends from one of said at least one upstanding side wall.

* * * * *